United States Patent [19]
Roberts, Jr.
[11] 4,239,452
[45] Dec. 16, 1980

[54] BLADE TIP SHROUD FOR A COMPRESSION STAGE OF A GAS TURBINE ENGINE

[75] Inventor: Frank Roberts, Jr., Manchester, Conn.

[73] Assignee: United Technologies Corporation, Hartford, Conn.

[21] Appl. No.: 919,186

[22] Filed: Jun. 26, 1978

[51] Int. Cl.[2] ..... F01D 11/08
[52] U.S. Cl. ..... 415/172 A; 60/226 R
[58] Field of Search ..... 415/119, 170 R, 172 R, 415/172 A, 174, 199.5, 213 C, DIG. 1, 226 R; 60/221, 226 R

[56] References Cited

U.S. PATENT DOCUMENTS

| | | | |
|---|---|---|---|
| 3,720,060 | 3/1973 | Davies et al. | 60/226 R |
| 3,893,782 | 7/1975 | Pierpoline et al. | 415/119 |
| 4,057,362 | 11/1977 | Schwaebel | 415/172 A |

FOREIGN PATENT DOCUMENTS

| | | | |
|---|---|---|---|
| 1031805 | 6/1958 | Fed. Rep. of Germany | 415/172 A |
| 833985 | 11/1938 | France | 415/DIG. 1 |

*Primary Examiner*—Louis J. Casaregola
*Attorney, Agent, or Firm*—Robert C. Walker

[57] ABSTRACT

A blade tip shroud structure for a compression stage of a gas turbine engine is disclosed. Various concepts relating to shroud designs and their influence on blade performance are discussed. In accordance with the teaching contained herein, one shroud geometry includes a circumferentially extending recess in the wall of a case which circumscribes the tips of the blades. A surface at the bottom of the recess has discontinuities therein. The tips of the blades run line on line with the respective wall at the design operating condition of the engine in which the shroud structure is incorporated. In one embodiment axially skewed grooves and circumferentially extending grooves form the surface discontinuities.

16 Claims, 8 Drawing Figures

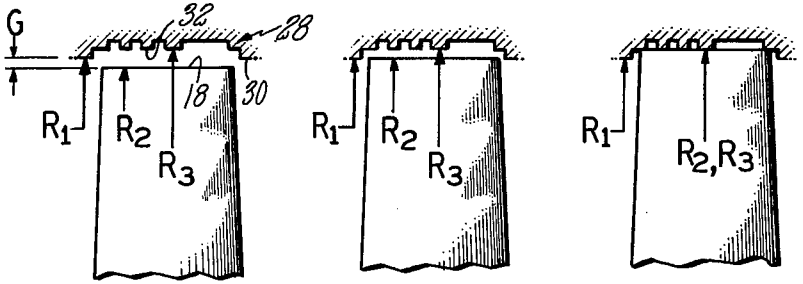
FIG. 5
FIG. 5A
FIG. 5B
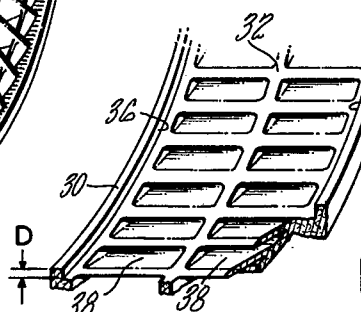
FIG. 2
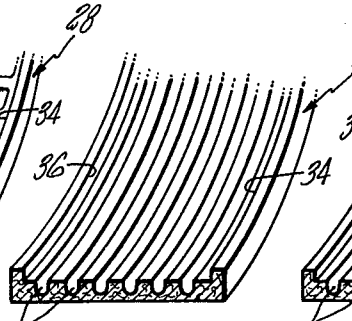
FIG. 3
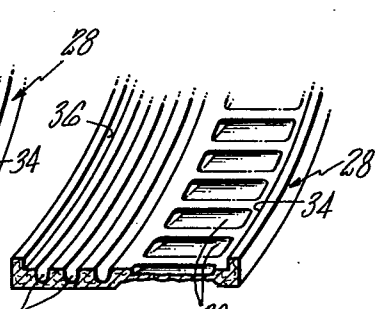
FIG. 4
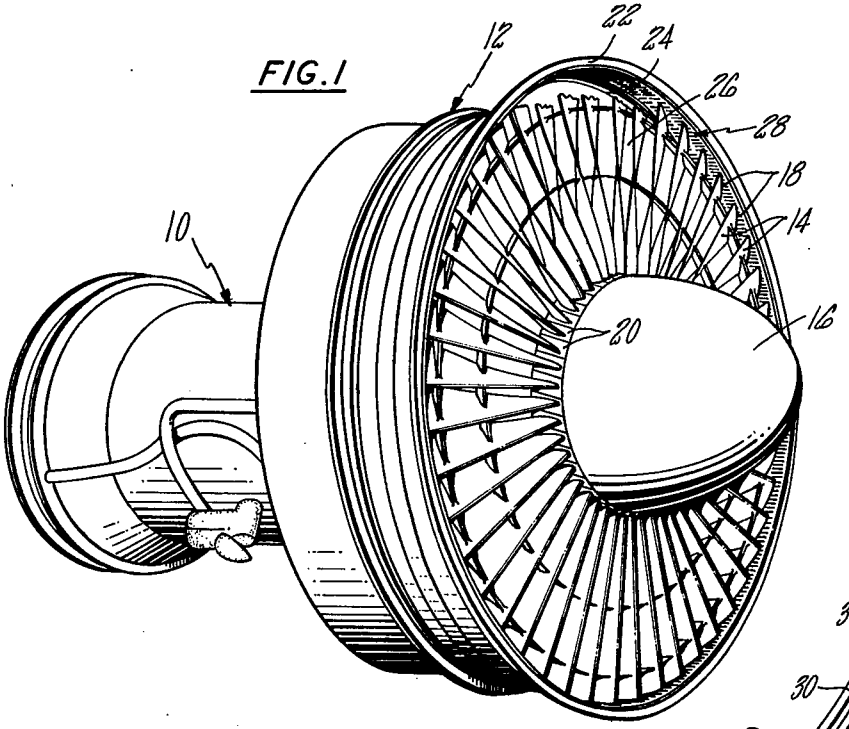
FIG. 1

BLADE TIP SHROUD FOR A COMPRESSION STAGE OF A GAS TURBINE ENGINE

BACKGROUND OF THE INVENTION

1. Field of the Invention

This invention relates to axial flow rotary machines, and more particularly to tip shrouds for compression stages of gas turbine engines.

2. Description of the Prior Art

The concepts of the present invention are described with respect to the fan stage of a turbofan, gas turbine engine. Although the concepts disclosed have applicability in other compression stages, most of the prior research and development in this area has been in relation to fan stages. In such fan stages a plurality of rotor blades extend radially outward from a rotor shaft across a flow path for the working medium gases. An engine case encloses the fan blades. A shroud housed in the engine case circumscribes the tips of the blades.

The aerodynamic efficiency of the fan stage is materially effected by the clearance between the tips of the blades and the corresponding seal land. As the clearance is increased, substantial amounts of working medium gases leak circumferentially over the tips of the blades from the pressure sides to the suction sides of the airfoils. Additionally, amounts of medium gases leak axially over the tips from the downstream end to the upstream end of the airfoils.

The historic approach in controlling leakage has been to minimize the clearance dimension between the tips and the corresponding shroud at the design operating condition. Such, however, is not an easy task as during operation of engine the relative radial distance between the tips of the blades and the corresponding shrouds varies substantially. For example, as the rotor is turned to speed, centrifugally generated forces cause the tips of the rotor blades to be displaced radially outward toward the corresponding shroud. Collaterally, flexure of the rotor and of the engine case causes relative displacements between blade tips and the corresponding shroud. Sufficient initial clearance between the tips and the shroud must be provided to prevent destructive interference during this initial period.

In an effort to avoid unduly large initial clearances many modern engines utilize abradable shrouds in which the airfoil tips are allowed to wear into the shrouds during transient excursions. U.S. Pat. Nos. 3,519,282 to Davis entitled "Abradable Material Seal"; 3,817,719 to Schilke et al entitled "High Temperature Abradable Material and Method of Preparing the Same"; and 3,918,925 to McComas entitled "Abradable Seal" are representative of such shrouds and their methods of manufacture. Accordingly, by such embodiments the clearance over the airfoil tips becomes the minimum clearance that will accommodate rotor excursions.

In addition to avoiding large initial clearances many modern engines employ porous shrouds such as those described in U.S. Pat. Nos. 3,580,692 to Mikolojczak entitled "Seal Construction"; and 3,843,278 to Torell entitled "Abradable Seal Construction". Such constructions are thought to improve engine performance by reducing the depth of the flow boundary layer adjacent to the suction side surfaces of the airfoils.

Other techniques for reducing leakage across the blade tips have been investigated. One such technique relevant to the presently disclosed concepts is reported in NASA Technical Memorandum X-472 by Kofskey entitled "Experimental Investigation of Three Tip-Clearance Configurations Over a Range of Tip Clearance Using a Single-Stage Turbine of High Hub to Tip-Radius Ratio". Specifically, the "recessed casing" reported in the memorandum and illustrated in FIG. 3(*b*) is of interest. In accordance with the Kofskey teaching improved efficiency over conventional, smooth wall shrouds is obtainable by submerging the tips of turbine blades into a recess in the corresponding shroud. A comparison of smooth wall and recessed casing efficiencies is shown in FIG. 8 of Kofskey. Also shown in Kofskey is a comparison in FIG. 6 between a recessed casing in which the blade tips are submerged and a recessed casing in which the blade tips run line on line with the flow path wall. The tests show the submerged construction to be markedly superior over the line on line construction by several percentage points in efficiency.

Notwithstanding the advanced state of the shroud art, manufacturers of rotary machines are devoting substantial resources in this area to the improvement of machine efficiencies and operating characteristics.

SUMMARY OF THE INVENTION

A primary aim of the present invention is to provide an effective shroud structure for circumscribing the tips of the blades in a compression stage of an axial flow rotary machine. High aerodynamic efficiency of the compression stage is sought while maintaining adequate surge margin.

According to the present invention the blades of a compression stage of an axial flow rotary machine are adapted to run in line on line relationship with the outer wall of the working medium flow path over a recess in the outer wall which circumscribes the tips of the blades and which has a plurality of surface discontinuities at the bottom thereof.

A primary feature of the present invention is the line on line proximity of the tips of the blades to the outer wall of the flow path wall at the design condition. Another feature is the recess in the outer wall over the blade tips. In one embodiment a plurality of parallel grooves extend circumferentially around the case at the bottom of the recess. In another embodiment a multiplicity of axially extending, skewed grooves are spaced circumferentially at the bottom of the recess. In yet another embodiment axial skewed grooves in the forward portion of the recess are combined with circumferentially extending grooves in the after portion of the recess.

A principal advantage of the present invention is high aerodynamic efficiency enabled by allowing the blades to extend over the full height of the fluid flow path at the design operating condition. Structural interference between the tips of the blades and the circumscribing seal lands is avoided by providing a recess in the outer wall of the flow path over the tips. Windage losses are avoided by running the tips of the blades in line on line relationship with the outer wall at the cruise condition rather than submerging the tips of the blades into the recess. Axially, skewed grooves and circumferentially extending grooves at the bottom of the recess enhance surge margin.

The foregoing and other objects, features and advantages of the present invention will become more apparent in the light of the following detailed description of the preferred embodiment thereof as shown in the accompanying drawing.

BRIEF DESCRIPTION OF THE DRAWING

FIG. 1 is a perspective view of a turbonfan, gas turbine engine showing a seal land circumscribing the tips of the fan blades;

FIG. 2 is a perspective view of a portion of a seal land constructed in accordance with the present invention;

FIG. 3 is a perspective view of a portion of a second seal land constructed in accordance with the present invention;

FIG. 4 is a perspective view of a portion of a third seal land constructed in accordance with the present invention;

FIG. 5 is a simplified illustration of the relationship of the blade tips to the seal land at installation;

FIG. 5A is a simplified illustration of the relationship of the blade tips to the seal land at the design operating condition;

FIG. 5B is a simplified illustration of the relationship of the blade tips to the seal land during unequal loading of the fan case or engine rotor.

DETAILED DESCRIPTION

Figure 6:
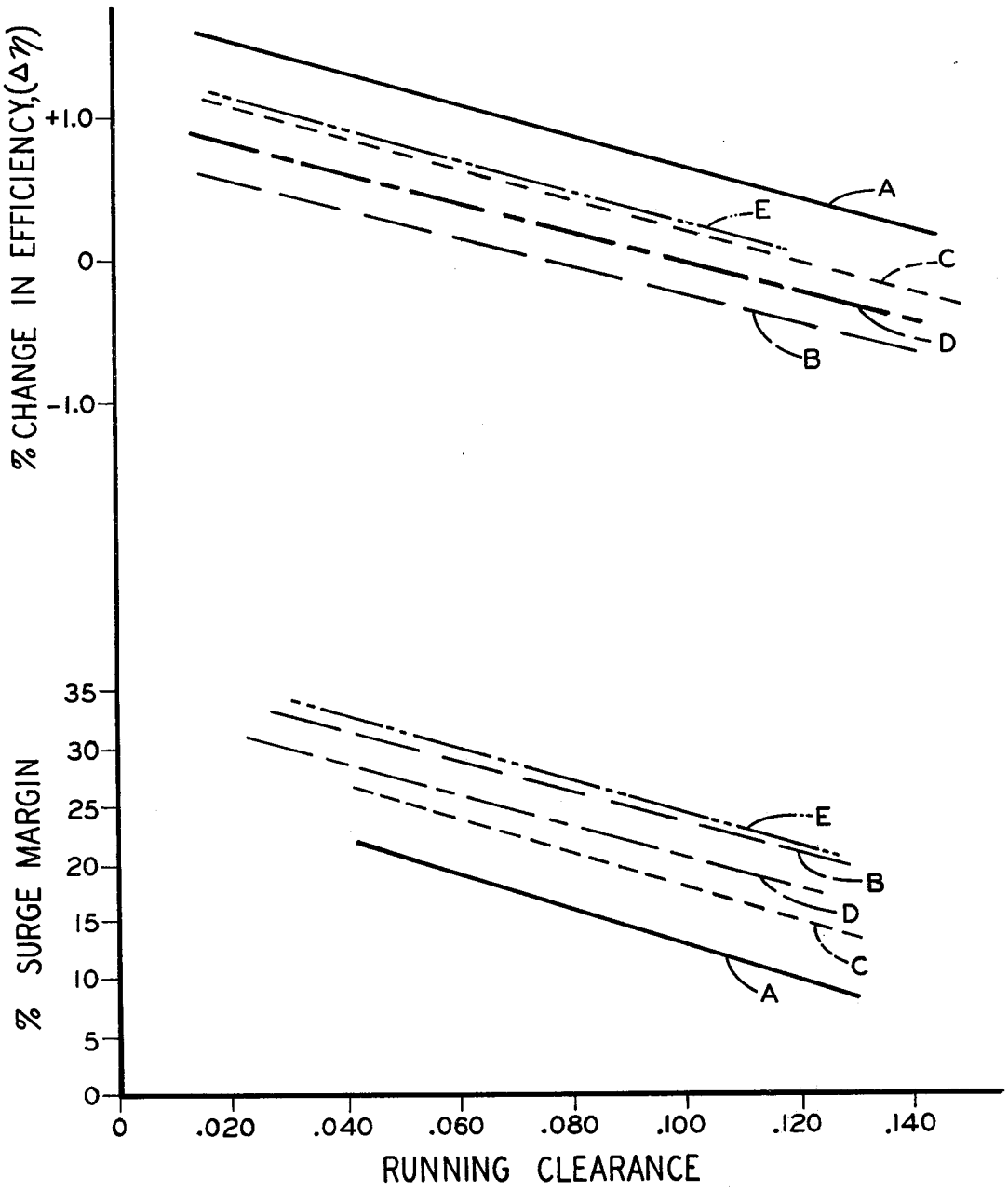
FIG. 6 is a graph comparing relative efficiencies and surge margin across a fan stage incorporating the various shrouds referenced.

A turbofan, gas turbine engine of the type utilized to power commercial airliners is illustrated in FIG. 1. The engine principally includes a core section 10 and a fan section 12. A plurality of unshrouded fan blades 14 in the fan section extend radially outward from a rotor 16. Each fan blade has a tip 18 and a platform 20. A fan case 22 encloses the blades and forms a portion of the outer wall 24 of the flow path 26 for working medium gases leading to the fan blades. A shroud 28, sometimes referred to as an outer air seal, is housed in the outer wall and circumscribes the tips of the fan blades. The shroud is commonly formed of a plurality of arcuate segments disposed in end to end relationship in the case 22.

As is illustrated in FIGS. 2–4, each shroud has a first inwardly facing surface 30 which forms a portion of the outer wall of the flow path and a second inwardly facing surface 32 recessed therefrom to a depth D. The recessed portion has an upstream end 34 and a downstream end 36 and includes a plurality of surface discontinuities at the bottom of the recess. The FIG. 2 shroud has, for example, a plurality of axially oriented grooves 38 which are skewed with respect to a radial line from the axis of the engine. The number of grooves 38 exceeds the number of blades 14 by at least a factor of two (2). The FIG. 3 shroud has a plurality of circumferentially extending grooves 40. The FIG. 4 shroud combines axial grooves 38 at the forward end of the shroud recess with circumferential grooves 40 at the rearward end of the shroud recess.

As is illustrated in FIG. 5, the first inwardly facing surface 30 of the shroud 28 is at a distance $R_1$ from the axis of the engine. The tip 18 of each blade is at a distance $R_2$ from the axis of the engine. The second inwardly facing surface 32 at the bottom of the recess is at a distance $R_3$ from the axis of the engine. Blade span S is the distance between the platform and tip of each blade.

In the cold condition the blade tips 18 and the first inwardly facing surface 30 bear the relationship illustrated in FIG. 5. The cold gap G between tips and surface enables assembly of the components. In response to centrifugally generated forces, and in some embodiments thermally generated forces, as the engine is accelerated though idle toward the design speed, the rotor tips grow radially outward into line on line relationship with the first inwardly facing surface of the seal land. The line on line relationship at the design condition is illustrated in FIG. 5A. Periodically, unequal loadings on the fan case and/or the engine rotor cause the tips of the blades to deflect into the recess as illustrated in FIG. 5B. The recess accommodates such excursions of the blade tips without destructive interference.

The initial distance $R_1$ and $R_2$ are provided such that the blade tips and the inwardly facing surface reach an equivalent radius at the design condition. The initial distance $R_3$ is such as will accommodate excursion of the blade tips into the shroud. The depth D of the recess in a fan embodiment for one commercial turbofan engine having a blade span on the order of thirty (30) inches is approximately seventy thousandths (0.070) of an inch. In such an embodiment, the clearance to span ratio during operation is twenty-three ten thousandths (0.0023). For blades of shorter span correspondingly higher clearance to span ratios are effective.

Several types of shrouds employing surface discontinuities have been utilized in the past. Representative types are referred to in the Prior Art section of this specification. Such treatments are known to be effective in increasing the surge margin across a stage, but are generally conceded to have a degrading effect on aerodynamic efficiency. Comparisons of relative efficiency and relative surge margin for recessed and non-recessed shrouds are illustrated by the FIG. 6 graph. Surge margin and efficiency data for the fan stage of the JT9D-7Q type turbofan engine manufactured by Pratt & Whitney Aircraft is reported.

Line A reports data for a shroud having a smooth wall;

Line B reports data for a shroud having axially skewed grooves only;

Line C reports data for a shroud having circumferentially extending grooves only;

Line D reports data for a shroud having combined axially skewed grooves and circumferentially extending grooves; and Line E reports data for a shroud constructed in accordance with the present invention including the recess having axially skewed grooves and circumferentially extending grooves at the bottom thereof (FIG. 4).

As revealed by FIG. 6, the addition of surface discontinuities to an otherwise smooth wall enhances surge margin at the expense of stage efficiency. The combination of recessed wall and surface discontinuities, however, enables a return to efficiencies approaching the efficiencies of smooth wall shrouds. Collaterally, the combination has a further enhanced surge margin.

Although the invention has been shown and described with respect to preferred embodiments thereof, it should be understood by those skilled in the art that various changes and omissions in the form and detail thereof may be made therein without departing from the spirit and the scope of the invention.

Having thus described typical embodiments of my invention, that which I claim as new and desire to secure by Letters Patent of the United States is:

1. A compression stage for an axial flow rotary machine, which comprises:

a case forming a portion of the outer wall of the flow path for working medium gases of the fan stage;

a shroud housed in said fan case and having a first inwardly facing surface, a second inwardly facing surface recessed from said first surface wherein the second surface has a plurality of surface discontinuities formed therein; and a plurality of unshrouded compression blades each having a tip which extends into line on line relationship with the first inwardly facing surface of said shroud at the design operating condition of the compression stage.

2. The apparatus according to claim 1 wherein said compression stage is the fan stage of a turbofan, gas turbine engine.

3. The apparatus according to claim 2 wherein each of said blades has a platform at the base thereof and wherein each blade has a span length S defined as the distance from the platform to the tip of the blade, the second surface of the shroud being recessed from the first surface of the shroud by a distance D which is approximately two tenths percent (0.2%) of the span length.

4. The apparatus according to claim 3 wherein the span length of the blades is approximately thirty (30) inches.

5. The apparatus according to claim 1 wherein said surface discontinuities in said second surface include a plurality of axially extending grooves at the bottom of the recess and wherein the number of grooves in said plurality of grooves exceeds the number of blades in said plurality of blades by at least a factor of two (2).

6. The apparatus according to claim 5 wherein each of said axially extending grooves is skewed in the direction of machine rotation with respect to a radial line drawn from the axis of rotation of the machine.

7. The apparatus according to claim 6 wherein said surface discontinuities in said second surface include a plurality of circumferentially extending grooves at the bottom of the recess.

8. The apparatus according to claim 1 wherein said surface discontinuities in said second surface include a plurality of circumferentially extending grooves at the bottom of the recess.

9. The apparatus according to claim 2 wherein said surface discontinuites in said second surface include a plurality of axially extending grooves at the bottom of the recess and wherein the number of grooves in said plurality of grooves exceeds the number of blades in said plurality of blades by at least a factor of two (2).

10. The apparatus according to claim 9 wherein each of said axially extending grooves is skewed in the direction of machine rotation with respect to a radial line drawn from the axis of rotation of the machine.

11. The apparatus according to claim 10 wherein said surface discontinuities in said second surface include a plurality of circumferentially extending grooves at the bottom of the recess.

12. The apparatus according to claim 10 wherein each of said blades has a platform at the base thereof and wherein each blade has a span length S defined as the distance from the platform to the tip of the blade, the second surface of the shroud being recessed from the first surface of the shroud by a distance D which is approximately two tenths percent (0.2%) of the span length.

13. The apparatus according to claim 11 wherein the span length of the blades is approximately thirty (30) inches.

14. The apparatus according to claim 2 wherein said surface discontinuities in said second surface include a plurality of circumferentially extending grooves at the bottom of the recess.

15. The apparatus according to claim 14 wherein each of said blades has a platform at the base thereof and wherein each blade has a span length S defined as the distance from the platform to the tip of the blade, the second surface of the shroud being recessed from the first surface of the shroud by a distance D which is approximately two tenths percent (0.2%) of the span length.

16. The apparatus according to claim 15 wherein the span length of the blades is approximately thirty (30) inches.

* * * * *